United States Patent [19]

van Megen

[11] 4,026,452

[45] May 31, 1977

[54] MAGAZINE FOR STORING ZIGZAG FOLDED BELT MATERIAL

[75] Inventor: Hubertus Johannes van Megen, Arcen, Netherlands

[73] Assignee: Oce-van der Grinten N.V., Venlo, Netherlands

[22] Filed: Apr. 26, 1976

[21] Appl. No.: 680,194

[30] Foreign Application Priority Data

Apr. 28, 1975 Netherlands ..... 7505025

[52] U.S. Cl. ..... 226/119; 270/61 F; 270/79

[51] Int. Cl.² ..... B65H 17/42

[58] Field of Search ..... 226/118, 119, 113, 114; 270/61 F, 79; 355/16; 271/165, 166

[56] References Cited

UNITED STATES PATENTS

| | | | |
|---|---|---|---|
| 3,503,606 | 3/1970 | Castellanet | 271/166 |
| 3,756,488 | 9/1973 | van Megen | 226/119 |
| 3,947,013 | 3/1976 | Nystrand | 270/79 |

*Primary Examiner*—Richard A. Schacher

*Attorney, Agent, or Firm*—Albert C. Johnston

[57] ABSTRACT

In a magazine for receiving, storing and delivering a long zigzag foldable belt having successive sections thereof stacked one upon another in upwardly bowed postures between zigzag folds bearing against oppositely disposed, downwardly convergent guide walls, proper placement of successive incoming belt sections on the stack within the magazine is effected, without need for precise synchronization of the feeding of the belt with the movement of fold positioning mechanism, by engagement of the entering belt folds with portions of continuously moving carriers, such as toothed belts or rollers protruding into and driven substantially vertically downwardly along upper regions of the magazine at the opposite sides thereof, which carrier portions displace the successive entering folds downwardly and lay them gently into their proper stacked position. The invention is particularly useful for stacking sections of a prefolded endless belt of photoconductive sheet material employed as the image forming medium in indirect electrophotographic copying machines.

6 Claims, 3 Drawing Figures

MAGAZINE FOR STORING ZIGZAG FOLDED BELT MATERIAL

This invention relates to a magazine for storing belt material, such as a long zigzag foldable belt for use in electrophotography, in a stack of zigzag folded belt sections disposed one upon another so that lengths of the belt may be drawn readily from the bottom of the stack and corresponding lengths fed and folded onto the top of the stack.

In electrophotographic copying processes, particularly one of the indirect type utilizing an endless belt as the photoconductive element, and more particularly when the photoconductive material exhibits a memory effect, it has been proposed to employ a long belt as the image forming medium and to store a large part of the length of this belt in a stack of zigzag folded sections thereof disposed one over another in a darkened magazine, thus enabling used sections of the belt to become rid of residual memory effects before being used again for the copying operations. Such a process and apparatus for carrying it out are described in U.S. Pat. No. 3,926,625 issued Dec. 16, 1975 to Martin L. van der Sterren.

The efficiency of utilization of the said process and apparatus is influenced by the functioning of the magazine into which the belt is fed, folded and stacked, and from which it is subsequently withdrawn. A magazine suitable for the purpose is shown and described in U.S. Pat. No. 3,756,488 issued on Sept. 4, 1973 to H. J. Van Megen and Willem P. H. A. Janssen. However, the known mechanism for positioning incoming sections of the belt in this magazine whereby the successive folds are layed down in proper stacked position, requires rather precise synchronization between the operation of this mechanism and the feeding or positions of the belt folds entering the magazine.

An object of this invention is to provide a simple mechanism which will ensure the proper positioning of entering zigzag folded sections of a belt onto a stack thereof within a magazine without requiring precise synchronism of the operation of this mechanism with the feeding and positions of folds of the belt. Accordingly, improper folding or stacking as a result of a loss of snychronism due to slippage either of the belt or in the drive mechanism will be avoided.

It has been found that this object can be attained by providing in upper regions of the guide walls of the magazine, across the path of the folds of the entering belt sections, continuously downwardly moving carriers which engage with the entering folds and carry them down so as to lay them and the respective belt sections between them in proper place onto underlying belt sections of the stack in the magazine.

Preferably, engagement with the folds is effected by portions of moving endless carriers, such as belts or rollers, which have external teeth or projections, and which preferably extend substantially vertically at the points of such engagement.

Such belts or rollers may extend through openings in upper edge portions of the guide walls with their support and drive system installed outside the magazine, so that only their functional portions extend slightly into the magazine so as to come into effective engagement with the folds.

The moving carriers need not engage the entire length of the folds of the endless belt (in the direction of its width). They preferably are situated only near the front and the rear of the magazine so as to occupy only a small part of the span of the guide walls.

For a positive drive in the use of belts for placing the folds, the belts preferably are toothed both externally and internally and are driven by a toothed roller engaging teeth on their inner side. Belts toothed only externally, however, can also be driven positively by providing a toothed drive roller in engagement with teeth of a portion of the belt outside the magazine.

The foregoing and other objects, features and advantages of the invention will be further apparent from the following detailed description and the accompanying drawings of an illustrative embodiment thereof.

Figure 1:
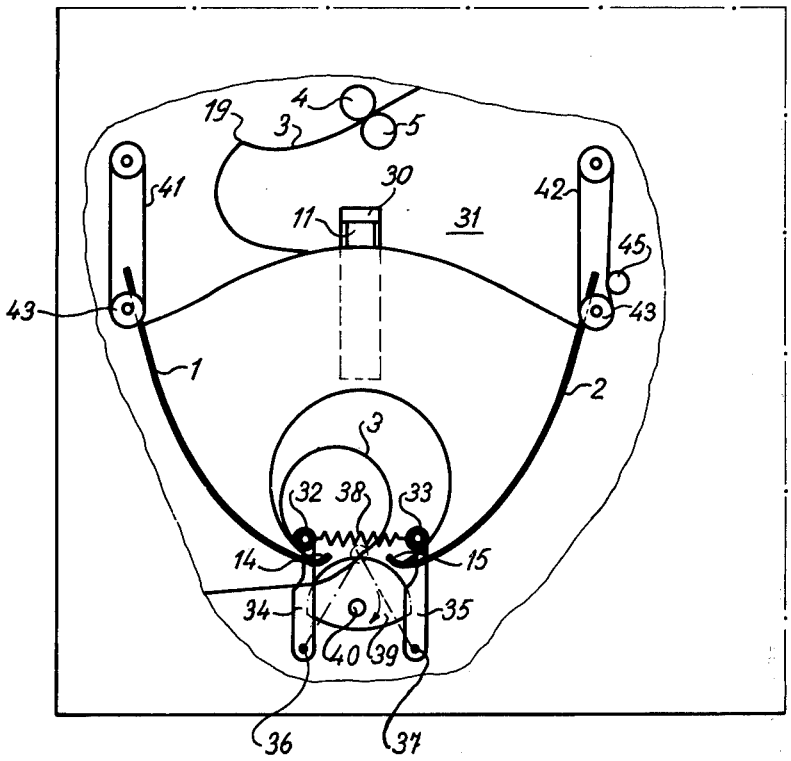
FIG. 1 is a schematic vertical cross-sectional view of a magazine according to the invention.

The magazine of FIG. 1 has two opposite guide walls 1 and 2, each of which has a smooth inner surface and which from top to bottom converge gradually toward the center.

Figure 3:
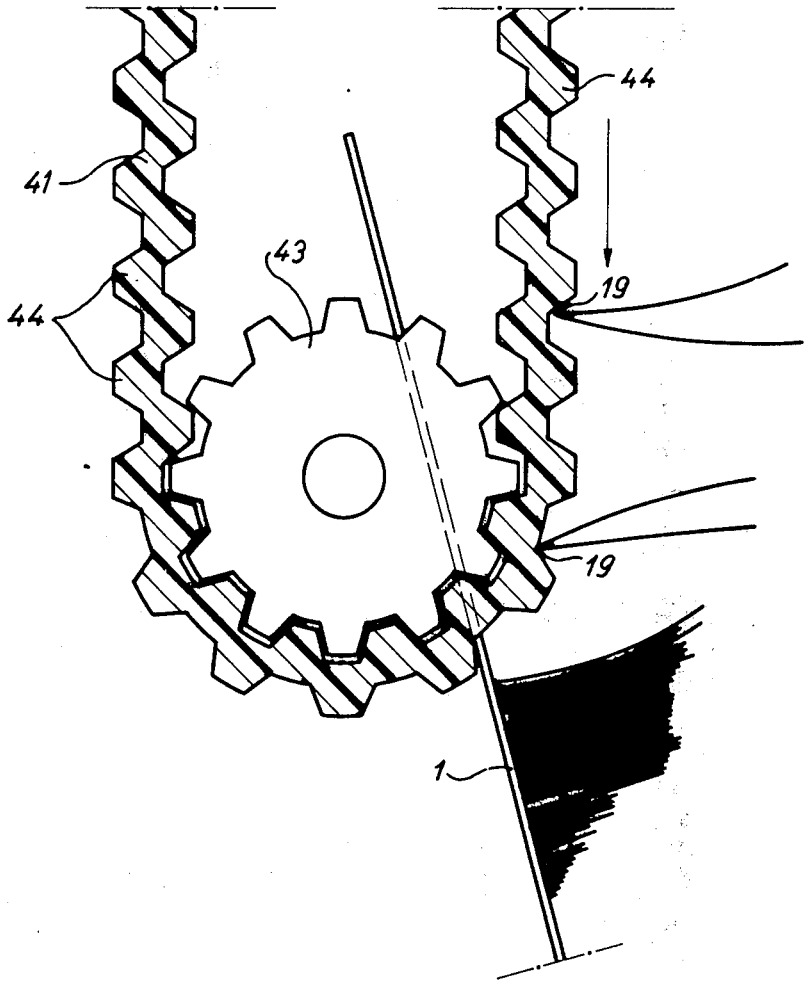
FIG. 3 is an enlarged cross-sectional view along the line III — III of FIG. 2 through the lower portion of one of the driving belts, schematically showing its association with the folded photoconductive belt.

A continuous belt 3, to be used for example as a photoconductive belt for making electrophotographic copies, has a plurality of zigzag folds which are continuously present but which are of such a nature that between transport rollers they can extend into a flat position, although the invention might also be applied with material in which zigzag folds are only made exclusively for stacking in the magazine just before the delivery into the magazine. The edges of such folds are shown at 19 as illustrated in FIG. 1 and 3. The belt 3 is conveyed between supply transport rollers 4 and 5 which are driven in such a known way that they lay down the materials 3 into the magazine. The belt can be removed at the bottom of the magazine by additional drive rollers (not shown). The photoconductive belt 3 is preferably an endless belt which can be transported along various processing stations and can subsequently be fed back again into the magazine. Such processing stations may consist of a charging station, an exposing station, a developing station, and a transfer station for a developed image, when using the belt for electrophotographic copying; all of this nonillustrated equipment may be that shown and described, for example, in the aforementioned U.S. Pat. No. 3,926,625, but other suitable known means are equally applicable.

Figure 2:
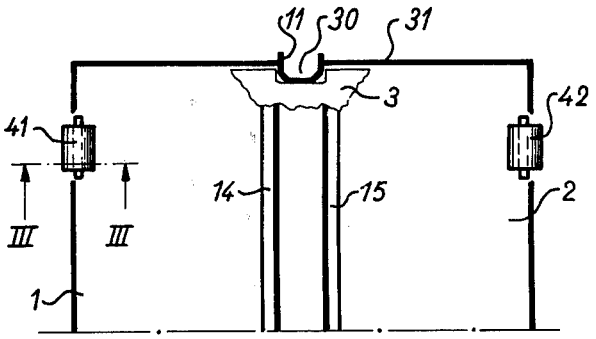
FIG. 2 is a schematic partial top plan view of the magazine shown in FIG. 1.

As shown in FIG. 2, at each side of the stack of belt material formed in this magazine guides 11 are placed, which may consist of U-shaped bodies which extend into each of the front and rear walls 31 of the magazine through openings 30. The front and rear walls 31 together with the guide walls 1 and 2 form a darkened chamber for collection and storage of the continuous belt, which is of significance when the belt is of photoconductive material exhibiting a memory effect. Each guide 11 may be slightly inclined, so that the lower extremity of each extends further into the magazine than the upper extremity. The zigzag belt 3 may have incisions in the edges, for each belt lying at the middle between two successive folds, into which incisions the guides 11 can extend in such a way that they keep the stack in its position and prevent is from moving sideways. The incisions in the belt have been rounded off in such a way that they do not have sharp corners. The guides 11 may have chamfered edges and may be adjustable in height and inclination.

By reason of the inclined position of the guides 11 their lower ends act as arresting means to gently hold the stack, and prevent too fast a descent of the same. Additionally, the guide walls 1 and 2 are respectively provided with thresholds 14 and 15 as holding means at the lower edge. The lower folds of the stack are arrested by these thresholds in order that in the bottom portions of the stacked zigzag belt, an upward bow-like force is built up which helps to support the stack binding upon the belt as it leaves the magazine.

Near the delivery opening for the belt and above the thresholds 14 and 15, guide bars 32 and 33 are mounted parallel to the folds 19 of the belt, and extend transversely throughout the width of the magazine through an opening in the front and rear walls 31. Outside of the magazine, they are connected with arms 34 and 35 respectively, pivoted at 36 and 37 respectively. The arms 34 and 35 are urged towards one another by a spring 38, and between them a cam 39 is rotatably mounted on shaft 40.

The operation of the above-described mechanism follows: From the rollers 4 and 5 the belt 3 is supplied to the magazine between the guide walls 1 and 2, whereupon the fold represented at 19, top left in FIG. 1, is laid down in the magazine against the guide wall 1 in a well-known manner such as shown and described, for example, in said U.S. Pat. No. 3,756,488. Thus a stack is built up in the magazine by the belt, which stack is more curved towards the bottom that at the top, and which stack forms a sharp bow at the bottom, of which bow the lower parts are supported by the lower ends of the guide walls 1 and 2 at the place where they are are formed into the thresholds 14 and 15. The guides 11 support the stack along the side edges as previously described. The strong bow forces produced in the lower portions of the magazine by the strongly curved shape, act to support the stack. To that end, the guide walls 1 and 2 gradually converge to a greater extent towards the bottom, so that the folds are pressed inwardly with greater force than would otherwise naturally occur. The belt 3 is then removed from the bottom of the magazine, the guide bars 32 and 33 being moved to and fro in such a way that they keep the stack properly in its bowed position and prevent the inner sections of the stack from sagging or otherwise bowing improperly. To effect this purpose, the cam 39 is so shaped and driven that it holds the guide bar 32 against the belt at the place of withdrawal until shortly after the position of the belt 3 is as it is shown near the bottom of the magazine in FIG. 1. Immediately afterwards, guide bar 32 starts moving inwardly toward the right in FIG. 1, whereas guide bar 33 holds its position, and thus keeps the belt 3 in its position against threshold 15. Bar 32 thus guides the belt when it leaves the magazine, and permits the fold on the left to be delivered and pass smoothly, by no longer pressing on the stack at the left bottom side. For permitting delivery of the fold on the right, which is now to be removed, guide bar 33 will be moved inwardly, whereas guide bar 32 continues pressing the stack towards the left.

According to the present invention, moving carrier members have been mounted near the upper extremities of the guide walls 1 and 2 in order to engage the incoming folds 19 of the belt 3. In the example of the embodiment shown, these moving members comprise toothed drive belts 41 and 42, each of which runs over a pair of vertically spaced rollers. These drive belts are designed to be toothed both internally and externally, and as shown in FIG. 3 drive belt 41 runs over the toothed drive roller 43. Such double-toothed drive belts are of course more costly than belts toothed only on one side, as normally available in the market, and if a less expensive version is used, with the belt being toothed only on the outside, a toothed drive roller 45 engaging externally with the belt as shown in FIG. 1 may be employed. In this event, a special counterpressure roller (not shown) may be desirable.

Near the upper edges of the guide walls 1 and 2 and spaced at a short distance from the front and the rear walls 31 of the magazine, openings have been made as indicated in FIG. 2. Portions of the relatively small drive belts 41 and 42 lie in these openings. A similar part of drive belts (not shown) are located similarly near the other end of the guide walls 1 and 2.

The operation of these drive belts will be clearly evident from FIG. 3. The belts are driven continuously so that the external teeth 44 on the portion of each belt located inside the magazine move downwardly continuously with a speed which is suitably adapted to the speed of delivery of folds of the belt 3 into the top of the magazine. When, as seen in FIG. 3, a fold 19 entering the left side of the magazine is moved further toward the left and downwardly by a further feeding of the belt 3, this fold 19 is pressed into a notch between two successive teeth 44 of the belt 41, by means of which this fold is carried downwardly and is then laid and evenly upon underlying folds in the stack already in the magazine.

As previously made clear, the continuously moving carriers for laying down the folds may have the form of rollers instead of the belts. They of course may also be given configurations other than the preferred forms above described. The projections for engaging the folds 19 need not be in the form of teeth, but may be surface formations or projections of other types that will engage with folds of the belt entering the magazine and displace them downwardly so as to lay them upon underlying folds. While a toothed drive is preferred in the use of belts for lying down the folds, other belt drive means such as a suitable friction drive may be employed. In all cases according to the invention, the moving carriers will act to engage the folds and lay them downwardly in such a manner that a properly formed stack of zigzag folded belt sections is maintained in the magazine without need for exact synchronization of the movement of these carriers with the feeding of folds of the belt.

Various forms and types of means other than those shown and described may be used for assisting removal of the belt from the magazine or for arresting the folds of the belt near the delivery opening of the magazine.

While the invention has been described with particular reference to the storage of folded sections of an endless belt of photoconductive sheet material, its applicability to the stacking of other foldable belts or web materials for other purposes will be apparent to those skilled in the art.

What is claimed is:

1. In a magazine for receiving, storing and delivering portions of a continuous belt of flexible photoconductive sheet material prefolded in zigzag manner so that the successive sections thereof between the folds thereof are stackable one upon another, comprising two oppositely disposed upright guide walls defining therebetween a space for storing a stack composed of a large number of said sections disposed one upon another; an opening at the bottom of said walls for delivery of said belt; means for propelling said belt through said opening from the lower end of said stack; means engaging a portion of said belt at the top of said walls for depositing said belt onto said stack; said guide walls being spaced apart at an upper level of said space by a distance less than a length of each said section and having respective, oppositely disposed inner surfaces converging each toward the other, with each of said surfaces curved smoothly inwardly toward the center line of said space, from said upper level downward to lower end portions of said surface at the level of said delivery openings, so that said sections may be stacked in said space in upwardly bowed postures with their respective folds disposed on opposite portions of said inner surfaces and will be increasingly bowed upwardly as their respective folds progress downwardly on said surfaces, and means for positioning successive folds of said belt downwardly along opposite portions of said inner surfaces as the folds are deposited in said space, so that each belt section between two successive folds will be laid in upwardly curved posture upon a stack of said sections bowed upwardly in said space, the improvement wherein said means for positioning said belt portions comprise carrier members mounted near the upper ends of said guide walls and having inside said walls respectively downwardly movable surface portions located across the paths of and for engaging with successive folds of the entering belt length and means for positively driving said carrier members and thereby continuously moving said surface portions downwardly so as to carry folds engaged with them downward adjacent to said walls and lay the respective belt sections between such folds into place on underlying belt sections.

2. A magazine according to claim 1, said carrier members comprising at each of said guide walls at least one endless carrier each of which has a toothed external surface lying at least partially inside the related guide wall to constitute one of said surface portions, said toothed surface being formed to engage between teeth thereof at least one fold of the entering belt length.

3. A magazine according to claim 2, said endless carriers extending into said space through respective openings in upper edge portions of said guide walls.

4. A magazine according to claim 1, said carrier members comprising at each of said guide walls at least one endless belt having a toothed external surface and having a flight thereof extending substantially vertically inside the related guide wall to constitute one of said surface portions, said toothed surface being formed to engage between teeth thereof at least one fold of the entering belt length.

5. A magazine according to claim 4, each said endless belt also having a toothed internal surface, said driving means comprising a driven toothed roller engaging teeth of said internal surface.

6. A magazine according to claim 2, each of said guide walls having openings in upper edge portions thereof near the front and the rear ends thereof and having one of said endless carriers extending into said space through each of said openings, said carriers covering only a minor proportion of the span of the guide wall in the direction of said folds.

* * * * *

UNITED STATES PATENT OFFICE

CERTIFICATE OF CORRECTION

Patent No. 4,026,452 Dated May 31, 1977

Inventor(s) Hubertus Johannes van Megen

It is certified that error appears in the above-identified patent and that said Letters Patent are hereby corrected as shown below:

Column 2: Line 39, in place of "materials" read -- material --
Line 64, after "belt" insert -- part -- .

Column 3: Line 12, after "stack" insert -- without --
Line 32, in place of "that" read -- than --
Line 36, omit the first occurrence of "are".

Column 4: Line 18, in place of "part" read -- pair --
Line 31, after "laid" insert -- gently --.

Signed and Sealed this

Twenty-seventh Day of September 1

[SEAL]

Attest:

RUTH C. MASON
Attesting Officer

LUTRELLE F. PARKER
Acting Commissioner of Patents and Tradem